US011118118B2

(12) United States Patent
Sharma et al.

(10) Patent No.: US 11,118,118 B2
(45) **Date of Patent: *Sep. 14, 2021**

(54) PROCESS FOR REDUCING NITROGEN CONTENT OF HYDROCARBON FEED

(71) Applicant: RELIANCE INDUSTRIES LIMITED, Mumbai (IN)

(72) Inventors: Rajesh Vishnudev Sharma, Thane-Maharashtra (IN); Sanjeev Shriniwas Katti, Mumbai-Maharashtra (IN)

(73) Assignee: RELIANCE INDUSTRIES LIMITED, Mumbai (IN)

( * ) Notice: Subject to any disclaimer, the term of this patent is extended or adjusted under 35 U.S.C. 154(b) by 0 days.

This patent is subject to a terminal disclaimer.

(21) Appl. No.: 16/760,391

(22) PCT Filed: Oct. 30, 2018

(86) PCT No.: PCT/IB2018/058474

§ 371 (c)(1),
(2) Date: Apr. 29, 2020

(87) PCT Pub. No.: WO2019/087052

PCT Pub. Date: May 9, 2019

(65) Prior Publication Data

US 2020/0325403 A1 Oct. 15, 2020

(30) Foreign Application Priority Data

Oct. 31, 2017 (IN) ..... 201721038727

(51) Int. Cl.
*C10G 25/00* (2006.01)
*C10G 17/02* (2006.01)
*C10G 19/02* (2006.01)

(52) U.S. Cl.
CPC ..... *C10G 25/003* (2013.01); *C10G 17/02* (2013.01); *C10G 19/02* (2013.01); *C10G 2300/1044* (2013.01); *C10G 2300/1055* (2013.01); *C10G 2300/202* (2013.01); *C10G 2400/04* (2013.01)

(58) Field of Classification Search
CPC ..... C10G 25/02; C10G 25/003; C10G 27/02–14; C10G 19/02; C10G 17/00–10; C10G 2400/04; C10G 2300/202; C10G 2300/1044; C10G 2300/1055; C10G 25/05
See application file for complete search history.

(56) References Cited

U.S. PATENT DOCUMENTS 3,915,849 A * 10/1975 Zimmerman ..... C10G 53/08 208/253
5,525,210 A 6/1996 Wormsbecher et al.
6,531,103 B1 3/2003 Hakka et al.
6,551,501 B1 * 4/2003 Whitehurst ..... C10G 67/04 208/211
2004/0007506 A1 * 1/2004 Song ..... C10G 25/003 208/244
2004/0118749 A1 * 6/2004 Lesemann ..... C10G 25/003 208/211
2004/0260139 A1 * 12/2004 Klabunde ..... C10G 25/003 585/820
2005/0150837 A1 * 7/2005 Yang ..... C10G 25/05 210/670
2010/0210889 A1 * 8/2010 Hays ..... C22B 43/00 585/820
2014/0110629 A1 * 4/2014 Flores Sanchez ... B01J 20/3204 252/189
2016/0167015 A1 * 6/2016 Podsiadlo ..... B01J 20/0229 208/290
2018/0353893 A1 * 12/2018 Gupta ..... B01J 20/041

FOREIGN PATENT DOCUMENTS

CN 102977911 A * 3/2013

OTHER PUBLICATIONS

Potapenko, Transformations of thiophene compounds under catalytic cracking conditions, Jan. 25, 2012, Applied Catalysis B: Environmental 117-118 (2012) 177-184. (Year: 2012).*
Shakirullah, Desulphurization Study of Petroleum Products through Extraction with Aqueous Ionic Liquids, Jun. 2010, Journal of the Chilean Chemical Society, v.55 n2 (Year: 2010).*
ISR for International Application PCT/IB2018/058474.
Written Opinion for International Application PCT/IB2018/058474.
Maria Angeles Larrubie et al., "A FT-IR study of the adsorption of indole, carbazole, benzothiophene, dibenzothiophene and 4,6-dibenzothiophene over solid adsorbents and catalysts",Applied Catalysis A: General , Elsevier Science, (Jan. 29, 2002), vol. 224, pp. 167-168, XP027370539 [A] 1-11 * Whole document *.

* cited by examiner

*Primary Examiner* — Michelle Stein
(74) *Attorney, Agent, or Firm* — Ladas & Parry LLP

(57) ABSTRACT

The present disclosure relates to a process for reducing the content of sulfur compounds in a hydrocarbon feed using an adsorbent. The process of the present disclosure is simple, economic, efficient and environment friendly.

8 Claims, 1 Drawing Sheet

PROCESS FOR REDUCING NITROGEN CONTENT OF HYDROCARBON FEED

RELATED APPLICATION

Figure 1:
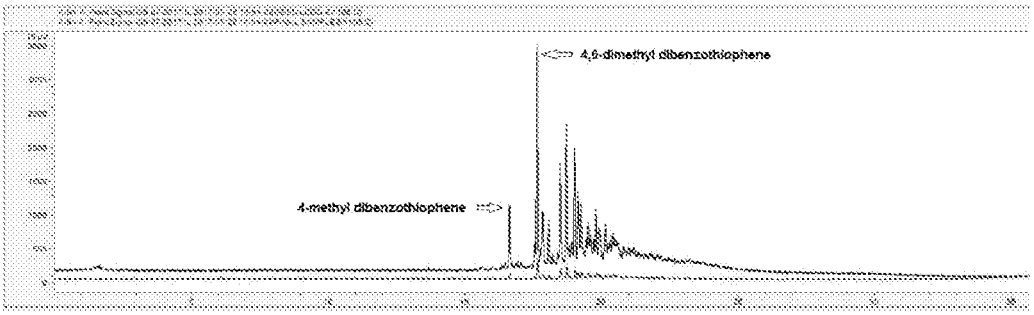

This application is a national phase entry under 35 USC 371 of International Patent Application No. PCT/IB2018/058474 filed on 30 Oct. 2018, which claim priority from Indian Application No. 201721038727 filed on 31 Oct. 2017, the disclosures of which are incorporated in their entirety by reference herein.

FIELD

The present disclosure relates to a process for reducing the content of sulfur compounds in a hydrocarbon feed, particularly for reducing the content of refractory organic sulfur compounds.

DEFINITIONS

As used in the present disclosure, the following term is generally intended to have the meaning as set forth below, except to the extent that the context in which it is used indicates otherwise.

The term 'refractory organic sulfur compounds' refers to sulfur containing heterocyclic aromatic compounds that are resistant to reaction with hydrogen during hydrotreating processes such as hydrocracking and hydroprocessing.

BACKGROUND

The background information herein below relates to the present disclosure but is not necessarily prior art.

Noxious sulfur oxides are produced due to the combustion of sulfur compounds which are entrained in hydrocarbon feed. The presence of sulfur oxides in air is associated with adverse effects on health, and environment. Governments all over the world are introducing norms and regulations to monitor and reduce the level of sulfur oxides in emissions from fuel combustion.

Conventional treatments remove most of the sulfur compounds in the fossil fuel easily. However, the refractory organic sulfur compounds, which comprise dibenzothiophene, benzothiophene, thiophene, and derivatives thereof, are difficult to remove. Current methods for removal of the refractory organic sulfur compounds involve hydrotreating at high temperature and high hydrogen pressure. The hydrotreatment is costly and complex. Further, the efficiency of the reducing the content of sulfur compounds is low and the yield of the desirable product are also low.

There is, therefore, felt a need to develop a simple, economic and efficient process for reducing the content of sulfur compounds in a hydrocarbon feed, particularly reducing the content of refractory organic sulfur compounds.

OBJECTS

Some of the objects of the present disclosure, which at least one embodiment herein satisfies, are as follows:

It is an object of the present disclosure to ameliorate one or more problems of the prior art or to at least provide a useful alternative.

An object of the present disclosure is to provide a simple, economic, and efficient process for reducing the content of organic sulfur compounds in a hydrocarbon feed.

Another object of the present disclosure is to provide a process for reducing the content of refractory organic sulfur compounds in a hydrocarbon feed.

Other objects and advantages of the present disclosure will be more apparent from the following description, which is not intended to limit the scope of the present disclosure.

SUMMARY

The present disclosure provides a process for reducing the content of sulfur compounds in a hydrocarbon feed. The process comprises mixing the hydrocarbon feed containing sulfur compounds with an adsorbent to obtain a mixture. The mixture is stirred at a temperature in the range of 25° C. to 80° C. for a pre-determined time period to obtain a biphasic mixture comprising an upper phase and a lower phase. The upper phase comprises treated hydrocarbon having reduced content of sulfur compounds, and the lower phase comprises a complex of the sulfur compounds and the adsorbent. The upper phase is separated from the biphasic mixture to obtain treated hydrocarbon having a reduced content of sulfur compounds. The amount of the reduced content of the sulfur compounds in the treated hydrocarbon feed is in the range of 0.1 ppm to 10 ppm.

The sulfur compounds comprise refractory organic sulfur compounds selected from the group consisting of dibenzothiophene, benzothiophene, thiophene, and derivatives thereof. The adsorbent is a mixture of a Lewis acid and a Lewis base and the mass of the adsorbent used for the process of the present disclosure is in the range of 0.25 mass % to 10 mass % of the mass of the hydrocarbon feed.

BRIEF DESCRIPTION OF THE ACCOMPANYING DRAWING

Figure 2:
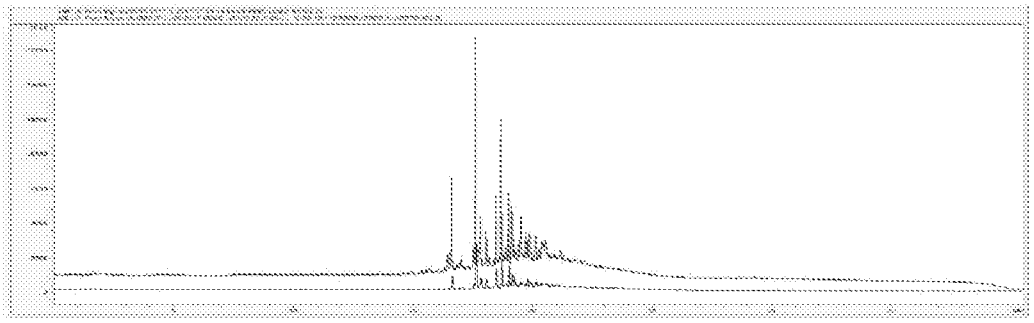

The process of the present disclosure will now be described with the help of the accompanying drawing, in which:

FIG. 1 illustrates a graphical representation (GC-SCD) showing the peak intensity of the refractory sulfur in the untreated diesel and treated diesel; and FIG. 2 illustrates a graphical representation (GC-SCD) showing the peak intensity of the recovery of the refractory sulfur in the untreated diesel and recovered sulfur from the adsorbent.

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open ended transitional phrases and therefore specify the presence of stated features, integers, steps, operations, elements, modules, units and/or components, but do not forbid the presence or addition of one or more other features, integers, steps, operations, elements, components, and/or groups thereof. The particular order of steps disclosed in the method and process of the present disclosure is not to be construed as necessarily requiring their performance as described or illustrated. It is also to be understood that additional or alternative steps may be employed.

As used herein, the term "and/or" includes any and all combinations of one or more of the associated listed elements.

The terms first, second, third, etc., should not be construed to limit the scope of the present disclosure as the aforementioned terms may be only used to distinguish one element, component, region, layer or section from another component, region, layer or section. Terms such as first, second, third etc., when used herein do not imply a specific sequence or order unless clearly suggested by the present disclosure.

Sulfur compounds present in a hydrocarbon feed are a cause of concern for petrochemical manufacturers, as their combustion produces sulfur oxides, which are harmful to the environment. Due to growing concern over decreasing the environmental damage caused by sulfur compounds in fuel, it is obligatory to reduce the content of sulfur compounds in the hydrocarbon feed.

The present disclosure envisages a simple, economic, and efficient process for reducing the content of sulfur compounds in a hydrocarbon feed, particularly reducing the content of refractory organic sulfur compounds.

In an aspect, the present disclosure provides a process for reducing the content of sulfur compounds in a hydrocarbon feed. The process is described in detail.

In the first step, the hydrocarbon feed containing sulfur compounds is mixed with an adsorbent to obtain a mixture.

The hydrocarbon feed is selected from the hydrocarbon feed that has sulfur content more than the desired. The hydrocarbon feed can be selected from naphtha and diesel. In one embodiment, the hydrocarbon feed is naphtha. In another embodiment, the hydrocarbon feed is diesel.

The hydrocarbon feed containing sulfur compounds comprise refractory organic sulfur compounds selected from the group consisting of dibenzothiophene, benzothiophene, thiophene, and derivatives thereof.

The adsorbent can be at least one selected from the group consisting of Lewis acids, Lewis bases, zeolites, metal organic frameworks, mixed metal oxides, activated carbon, and imprinted polymers. The amount of the adsorbent used in the process of the present disclosure is in the range of 0.25 mass % to 10 mass % of the mass of the hydrocarbon feed. Typically the amount of adsorbent used in the process of the present disclosure in the range of 0.25 mass % to 1 mass % of the mass of the hydrocarbon feed, reduces maximum sulfur content in the hydrocarbon feed.

In one embodiment, the adsorbent is a mixture of Lewis acid and Lewis base.

Lewis acidic adsorbents are used for ultra-low desulphurization of hydrocarbon fuel. The Lewis acid is at least one selected from the group consisting of $AlCl_3$, $FeCl_3$, $ZnCl_2$, $GaCl_3$, $InCl_3$, $TiCl_4$, $SnCl_4$, $BiCl_3$, and $ZrCl_4$.

The Lewis base is at least one selected from the group consisting of $Al(OH)_3$, $Fe(OH)_3$, and $Zn(OH)_2$.

The ratio of the Lewis acid to the Lewis base can be in the range of 1:1 to 5:1. The ratio of Lewis acid to the Lewis base is based on the hydrocarbon feed used. In one embodiment, when the hydrocarbon feed is naphtha, the Lewis acid to the Lewis base can be in the range of 3:1. In another embodiment, when the hydrocarbon feed is diesel, the Lewis acid to the Lewis base can be in the range of 2:1.

In accordance with one exemplary embodiment of the present disclosure, the adsorbent is a mixture of $AlCl_3$ and $Al(OH)_3$.

In accordance with another exemplary embodiment of the present disclosure, the adsorbent is a mixture of $FeCl_3$ and $Al(OH)_3$.

The adsorbent used in the process of the present disclosure interacts with the sulfur compounds present in the hydrocarbon feed resulting in formation of a complex of the sulfur compounds and the adsorbent. The adsorbents of the present disclosure are efficient for the removal of refractory organic sulfur compounds. The reason for high efficiency could be the high affinity of the adsorbents towards the lone pair of sulfur electron and also $7r$-electronic cloud of the aromatic sulfur compounds.

The mixture so obtained in the first step is stirred at a temperature in the range of 25° C. to 80° C. for a predetermined time period to obtain a biphasic mixture comprising an upper phase and a lower phase.

In the process of the present disclosure, the step of stirring can be carried out at atmospheric pressure, and at a temperature in the range of 25° C. to 80° C. In an exemplary embodiment, the stirring is carried out at atmospheric pressure, and at a temperature of 25° C.

The pre-determined time period can be in the range of 15 minutes to 120 minutes. In one embodiment the pre-determined time period is 30 minutes.

In one embodiment, it is observed that the use of adsorbent of the present disclosure significantly reduces the content of sulfur compounds of naphtha stream within 30 minutes of the reaction time at ambient temperature and pressure without the use of hydrogen gas. In another embodiment is observed that the use of adsorbent of the present disclosure significantly reduces the content of sulfur compounds of diesel stream within 40 minutes of the reaction time at ambient temperature and pressure without the use of hydrogen gas The so obtained biphasic mixture comprises upper phase and lower phase. The upper phase comprises treated hydrocarbon having reduced content of sulfur compounds, and the lower phase comprises a complex of the sulfur compounds and the adsorbent.

The upper phase can be separated from the biphasic mixture to obtain treated hydrocarbon having a reduced content of sulfur compounds.

The content of the remaining refractory organic sulfur compounds in the treated hydrocarbon can be in the range of 0.1 ppm to 10 ppm.

The reduction of sulfur compounds using the process of the present disclosure can be carried out at ambient temperature and ambient pressure without the use of hydrogen gas.

In accordance with an exemplary embodiment of the present disclosure, the total sulfur content of the naphtha stream is reduced from 405 ppm to less than 100 ppm using 0.45 mass % of the adsorbent. The total sulfur content of the naphtha stream is reduced from 405 ppm to less than 10 ppm using 1 mass % of the adsorbent.

In accordance with another exemplary embodiment of the present disclosure, the total sulfur content of the diesel stream is reduced from 50 ppm to 10 ppm using 2.5 mass % of the adsorbent. The process of the present disclosure is capable of producing petrochemical naphtha with total sulfur content below 50 ppm, and even below 10 ppm and diesel with total sulfur content below 10 ppm. Therefore, the process of the present disclosure is efficient.

The process of the present disclosure deals with reactive adsorption desulfurization process wherein the adsorbent has the potential to strongly bind aromatic organo-sulphur compounds via sulphur metal by sigma bonds and π-interactions. Further, the process of the present disclosure deals with ultra-low desulphurization of hydrocarbon fuel by removal of refractory sulphur species at ambient temperature, pressure and without $H_2$. More prominently, a quantity of dibenzothiophene, benzothiophene, and thiophene series refractive sulphur compounds is removed efficiently. The reactive extractive desulfurization process (REDS) after the conventional hydrotreatment process can help in attaining the goal of ultra-low desulfurization at lower capital and operating costs than required in a high severity standalone hydrotreatment process.

Conventionally, use of ionic liquid or liquid solution for removal of refractory organic sulfur compounds is disclosed. Whereas, the adsorbent used in the process of the present disclosure is in solid form before the step of desulfurization. Unlike the known art, the sulfur impurities in the present disclosure do not undergo any reaction such as alkylation, oxidation, or reduction. However, the impurities are recovered in their original chemical form. The process of the present disclosure is based on the hypothesis of strongly binding the Lewis acid/Lewis base combination to aromatic organo-sulphur compounds via sulphur metal by sigma bonds and π-interactions. This combination is purely inorganic in nature and does not require any solvents for aid.

Therefore, the process described in the present disclosure is simple. Further, the process has many advantages over the prior art such as use of mild operating conditions, and easy to control conditions. The adsorbents used are cheap and easily available. Therefore, the process of the present disclosure is economical.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

The present disclosure is further described in light of the following experiments which are set forth for illustration purpose only and not to be construed for limiting the scope of the disclosure. The following experiments can be scaled up to industrial/commercial scale and the results obtained can be extrapolated to industrial scale.

EXPERIMENTAL DETAILS

Example 1: Reduction of Content of Refractory Organic Sulfur Compounds in a Test Hydrocarbon Feed A test hydrocarbon feed was prepared by solubilizing refractory sulphur compounds, dibenzothiophene (DBT) and 2,5-dimethylthiophene, in dodecane so as to obtain a test hydrocarbon feed having final sulfur content of 150 ppm. The adsorbent used in this experiment was a mixture of aluminium chloride and aluminium hydroxide in a mole ratio of 3:1.

The test hydrocarbon feed (25 g) was mixed with the adsorbent (5 mass %) to obtain a mixture. The mixture was stirred at 50° C. under atmospheric pressure for 30 minutes at 300 rpm to obtain a biphasic mixture comprising an upper phase and a lower phase.

The upper phase comprising the treated test hydrocarbon was separated from the biphasic mixture by decantation. The treated test hydrocarbon was analyzed for total sulfur content using a total sulfur total nitrogen analyzer (TSTN analyzer).

It was observed that the content of dibenzothiophene (DBT) was reduced by 95% and the content of 2,5-dimethylthiophene was reduced by 98%.

Thus, the adsorbent of the present disclosure is found to be effective in reducing the content of refractory organic sulfur compounds in the test hydrocarbon feed.

Example 2: Effects of Amount of the Adsorbent

The adsorbent used for this experiment was a mixture of aluminum chloride and aluminum hydroxide in a mole ratio of 3:1. Naphtha stream having an initial total sulfur content of 405 ppm was used as the hydrocarbon feed.

Naphtha (100 g) was mixed with a various quantity of the adsorbent (Table 1 wherein the adsorbent quantity was taken in the range of 0.25 mass % to 50 mass %) to obtain a mixture. The mixture was stirred at 50° C. at atmospheric pressure for 30 minutes at 300 rpm to obtain a biphasic mixture comprising an upper phase and a lower phase.

The upper phase comprising the treated naphtha was separated from the lower phase by decantation. The treated naphtha was analyzed for total sulfur content using TSTN analyzer.

Table 1 shows the amount of adsorbent used and the total sulfur content of the treated naphtha.

TABLE 1

Effect of the amount of adsorbent

| Experiment no. | mass % of adsorbent | Total sulfur content of the treated naphtha (ppm) |
|---|---|---|
| Naphtha | — | 405 |
| 1 | 0.25 | 186 |
| 2 | 0.3 | 161 |
| 3 | 0.35 | 111 |
| 4 | 0.4 | 106 |
| 5 | 0.45 | 48 |
| 6 | 0.5 | 35 |
| 7 | 1 | 4.5 |
| 8 | 2 | 2.1 |
| 9 | 5 | 1.2 |
| 10 | 10 | 1.36 |
| 11 | 20 | 1.13 |
| 12 | 30 | 0.95 |
| 13 | 50 | 0.95 |

It is evident from Table-1 that the use of adsorbent of the present disclosure significantly reduces the content of sulfur compounds of the naphtha stream of the reaction time at ambient temperature and pressure without the use of hydrogen gas.

Thus, the total sulfur content of the naphtha stream was reduced from 405 ppm to less than 100 ppm using 0.45 mass % of the adsorbent. The total sulfur content of naphtha stream was reduced from 405 ppm to less than 10 ppm using 1 mass % of the adsorbent.

Example 3: Effect of Time

The adsorbent used for this experiment was a mixture of aluminium chloride and aluminium hydroxide in 3:1 mole ratio. Naphtha stream having an initial total sulfur content of 405 ppm was used as a hydrocarbon feed.

Naphtha (100 g) was stirred with the adsorbent (0.5 mass %) to obtain a mixture. The mixture was stirred at 50° C. for a predetermined time (in the range of 15 minutes to 120 minutes) at 300 rpm to obtain a biphasic mixture comprising an upper phase and a lower phase.

The upper phase comprising the treated naphtha was separated by decantation from the biphasic mixture. The treated naphtha was analyzed for total sulfur content using TSTN analyzer.

Table 2 shows the time and the total sulfur content of the treated naphtha.

TABLE 2

| Effect of time | | |
|---|---|---|
| Experiment no. | Time (minutes) | Total sulfur content of the treated naphtha (ppm) |
| Naphtha | — | 405 |
| 14 | 15 | 48 |
| 15 | 30 | 41 |
| 16 | 120 | 35 |

The data in Table-2 clearly shows that the reduction in the amount of sulfur compounds was high up to 30 minutes of reaction time.

Example 4: Effect of Temperature

The adsorbent used for this experiment was a mixture of aluminium chloride and aluminium hydroxide in 3:1 mole ratio. Naphtha stream having an initial total sulfur content of 405 ppm was used as a hydrocarbon feed.

Naphtha (100 g) was stirred with the adsorbent (0.5 mass %) to obtain a mixture. Batches of the mixture were stirred at various temperatures (Table 1, wherein the temperature is in the range of 25° C. to 50° C.) for 30 minutes at 300 rpm to obtain biphasic mixtures comprising upper phases and lower phases.

The liquid phases comprising the treated naphtha were separated by decantation from the biphasic mixture. The treated naphtha samples were analyzed for total sulfur content using TSTN analyzer.

Table 3 shows the temperature and the total sulfur content of the treated naphtha samples.

TABLE 3

| Effect of temperature | | |
|---|---|---|
| Sr. | Temperature (° C.) | Total sulfur content of the treated naphtha |
| Feed | — | 405 |
| 17 | 25 | 31 |

TABLE 3-continued

| Effect of temperature | | |
|---|---|---|
| Sr. | Temperature (° C.) | Total sulfur content of the treated naphtha |
| 18 | 35 | 34 |
| 19 | 50 | 35 |

From the data in Table 3 it is evident that the reduction in sulfur content of hydrocarbon stream is more effective at 25° C. as compared to 35° C. or 50° C.

Examples: 3; Reducing Sulfur Content from Diesel in Accordance with the Process of the Present Disclosure Diesel (100 g) with sulfur content of 50 ppm was obtained from hydro-processing unit which contains refractory organic sulfur compound (4,6-dimethyldibezothiophene and its isomers). The initial and final concentration of sulfur compounds in diesel samples was measured by TSTN analyzer and illustrated in Table 4.

100 g of the diesel sample was taken in 250 ml three necked round bottom flask and 2.5 wt % of adsorbent was added to the diesel sample. The adsorbent used for this experiment was a mixture of aluminium chloride and aluminium hydroxide in 2:1 mole ratio. The mixture was stirred at 50° C. under atmospheric pressure for 30 minutes at 300 rpm to obtain a resultant mixture. The so obtained resultant mixture was allowed to settle to obtain an upper phase and a lower phase.

The upper phase comprising the treated diesel was separated from the lower phase by decantation. The treated diesel was analyzed for total sulfur content using a total sulfur total nitrogen analyzer (TSTN analyzer). It was found that sulfur content has been reduced to 10 ppm.

FIG. 1 illustrates the GC-SCD graph showing that the refractive sulfur is reduced and peak intensity is low as compared to initial diesel sample (untreated diesel sample).

Recovery of Refractive Sulfur from Adsorbent:

After decantation, the lower phase was collected and treated with 10 ml of distilled water under stirring. Diesel was extracted using 10 ml of ethyl acetate. The initial diesel (untreated diesel) and extracted diesel from the lower phase shows the same GC-SCD pattern as illustrated in FIG. 2 which confirmed the recovery of refractive organic sulfur compound from adsorbent.

The untreated diesel and treated diesel samples were analyzed for PIONA analysis which confirmed that there is not a significant change in the composition of paraffin, naphthenes, and mono aromatics, as illustrated in Table 4. However, the composition of poly-aromatics had changed due to removal of refractive organic sulfur compounds from diesel (treated diesel).

TABLE 4

| | | | GCGC-FID | | | |
|---|---|---|---|---|---|---|
| Samples | GCSCD SULFUR | GCNCD NITROGEN | PARAFFINS | NAPTHENES | MONO-AROMATICS | POLY-AROMATICS |
| Initial diesel | 50 | 0.11 | 41.27 | 35.96 | 19.74 | 3.04 |
| Final diesel | 10 | Not detected | 42.19 | 36.33 | 19.15 | 2.33 |

TECHNICAL ADVANCEMENTS AND ECONOMICAL SIGNIFICANCE

The present disclosure described herein above has several technical advantages including, but not limited to, the realization of a process for reducing the content of sulfur compounds in a hydrocarbon feed, that is simple, and economic; and that is efficient.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the invention to achieve one or more of the desired objects or results. While certain embodiments of the inventions have been described, these embodiments have been presented by way of example only, and are not intended to limit the scope of the inventions. Variations or modifications to the formulation of this invention, within the scope of the invention, may occur to those skilled in the art upon reviewing the disclosure herein. Such variations or modifications are well within the spirit of this invention.

The numerical values given for various physical parameters, dimensions, and quantities are only approximate values and it is envisaged that the values higher than the numerical value assigned to the physical parameters, dimensions and quantities fall within the scope of the invention unless there is a statement in the specification to the contrary.

While considerable emphasis has been placed herein on the specific features of the preferred embodiment, it will be appreciated that many additional features can be added and that many changes can be made in the preferred embodiment without departing from the principles of the disclosure. These and other changes in the preferred embodiment of the disclosure will be apparent to those skilled in the art from the disclosure herein, whereby it is to be distinctly understood that the foregoing descriptive matter is to be interpreted merely as illustrative of the disclosure and not as a limitation.

The invention claimed is:

1. A process for reducing the content of sulfur compounds in a hydrocarbon feed, said process comprising carrying out the following steps in the absence of a solvent:

i. mixing said hydrocarbon feed containing sulfur compounds with an adsorbent to obtain a mixture;

ii. stirring said mixture at a temperature in the range of 25° C. to 80° C. for a pre-determined time period to obtain a biphasic mixture comprising an upper phase and a lower phase, wherein said upper phase comprises treated hydrocarbon having reduced content of sulfur compounds; and said lower phase comprises a complex of the sulfur compounds and the adsorbent; and iii. separating said upper phase from said biphasic mixture to obtain treated hydrocarbon having reduced content of sulfur compound, wherein the amount of said reduced content of the sulfur compounds in the treated hydrocarbon feed is in the range of 0.1 ppm to 10 ppm;

wherein said adsorbent is in solid form before mixing with said hydrocarbon feed containing sulphur compounds and sulphur compounds are recovered in their original form; and wherein said adsorbent is a mixture of a Lewis acid and a Lewis base;

wherein said Lewis acid is selected from the group consisting of $AlCl_3$, $FeCl_3$, $ZnCl_2$, $GaCl_3$, $InCl_3$, $TiCl_4$, $SnCl_4$, $BiCl_3$ and $ZrCl_4$; and said Lewis base is selected from the group consisting of $Al(OH)_3$, $Fe(OH)_3$ and $Zn(OH)_2$.

2. The process as claimed in claim 1, wherein said sulfur compounds comprise refractory organic sulfur compound selected from the group consisting of dibenzothiophene, benzothiophene, thiophene, and derivatives thereof.

3. The process as claimed in claim 1, wherein said hydrocarbon feed is selected from naphtha and diesel.

4. The process as claimed in claim 1, wherein the amount of said adsorbent is in the range of 0.25 mass % to 10 mass % of the total mass of said hydrocarbon feed.

5. The process as claimed in claim 1, wherein said adsorbent is a mixture of $AlCl_3$ and $Al(OH)_3$.

6. The process as claimed in claim 1, wherein said adsorbent is a mixture of $FeCl_3$, and $Al(OH)_3$.

7. The process as claimed in claim 1, wherein the ratio of said Lewis acid to said Lewis base is in the range of 1.1 to 5:1.

8. The process as claimed in claim 1, wherein said predetermined time period is in the range of 15 minutes to 120 minutes.

* * * * *